US008460092B1

(12) United States Patent
Slomiany

(10) Patent No.: US 8,460,092 B1
(45) Date of Patent: Jun. 11, 2013

(54) SYSTEM AND METHOD OF A GAMING MACHINE WITH CONNECTED TILES

(75) Inventor: Scott D. Slomiany, Rolling Meadows, IL (US)

(73) Assignee: Case Venture Management, LLC, Northbrook, IL (US)

( * ) Notice: Subject to any disclaimer, the term of this patent is extended or adjusted under 35 U.S.C. 154(b) by 1526 days.

(21) Appl. No.: 11/935,889

(22) Filed: Nov. 6, 2007

Related U.S. Application Data

(60) Provisional application No. 60/857,003, filed on Nov. 6, 2006.

(51) Int. Cl.
*A63F 9/24* (2006.01)

(52) U.S. Cl.
USPC ..... 463/25; 463/19; 463/20; 463/40

(58) Field of Classification Search
USPC ..... 463/19, 20, 25, 40
See application file for complete search history.

(56) References Cited

U.S. PATENT DOCUMENTS

| | | | | |
|---|---|---|---|---|
| 6,394,902 | B1 * | 5/2002 | Glavich et al. | 463/20 |
| 6,855,053 | B2 * | 2/2005 | Baerlocher | 463/16 |
| 6,855,054 | B2 * | 2/2005 | White et al. | 463/21 |
| 2002/0094854 | A1 * | 7/2002 | Morita et al. | 463/9 |

* cited by examiner

*Primary Examiner* — Paul A. D'Agostino
*Assistant Examiner* — Brandon Gray
(74) *Attorney, Agent, or Firm* — Michael H. Baniak; Seyfarth Shaw LLP

(57) ABSTRACT

A system and method for implementing a gaming machine with connected tiles is presented. In an embodiment, a wager is received. A game with a playfield having a tile base and a plurality of tile locations is executed. The tile locations of the playfield are populated with tiles having (i) differing subsets of symbols thereon and (ii) a connection path to the tile base. Some initially-hidden symbols are presented, and a selection of one of them is received and revealed. Any tiles in the playfield having a symbol matching the selected symbol are removed, along with any remaining tiles that no longer have a connection path to the tile base. These selection and removal steps are repeated according to a game methodology. The playfield is evaluated for an outcome. An award is presented in the event that the outcome in the game merits an award according to the game methodology.

6 Claims, 21 Drawing Sheets

SYSTEM AND METHOD OF A GAMING MACHINE WITH CONNECTED TILES

CROSS-REFERENCE TO RELATED APPLICATIONS

This application claims the benefit of U.S. provisional application No. 60/857,003, filed Nov. 6, 2006, entitled "System and Method of a Gaming Machine with Connected Tiles."

BACKGROUND

1. Technical Field

This invention relates to games of chance. In a preferred form, it is operated in a wagering environment. This invention generally relates to gaming machines, although it can have broader application to games in general, and more particularly to a novel bonus game for gaming machines.

2. Description of Related Art

Slot machines, poker machines, blackjack machines, and similar gaming machines are abundant. Some, such as slot machines, may be mechanical devices without any video component. Machines to play card games, as well as slot machines, are more and more commonly based upon a video monitor as the display mechanism for the game, with the game itself, however, governed by a microprocessor-based system.

The popularity of the games, and these gaming machines, derive from a number of factors, some of which are the apparent likelihood of winning (typically money in a wagering environment), the attractiveness of the game machine, and the basic level of entertainment provided by the game/machine. It is therefore one general driving force in the gaming industry to come up with new and exciting games and gaming machines that will attract players, entertain them, and promote repeated play.

One way the foregoing is accomplished is to enhance the play of a base game, where the base game may be a relatively standard-type game already established in the industry, with a bonus game. Such a bonus game can be one which is similar to the underlying game being played, or can be completely unrelated to the base game, in the sense of being a game different from that being played as the base game. For instance, the bonus round could be a separate wheel, which is spun in the course of play of a slots game when triggered by some event in the slots game.

In general, the bonus game ordinarily has some increased value associated with its play, and/or a statistically higher probability of success, just to name two ways in which heightened player appeal may be generated. An example of a bonus game incorporating some of the foregoing aspects is disclosed in U.S. Pat. No. 6,159,098.

As noted above, a bonus game is offered on many slot machines. The bonus game is usually actuated for play at random times, as by certain combinations resulting from the wagered play of the game, such as the occurrence of a certain pattern of symbols on the paylines wagered upon by the player on the slot machine, for example, a row of "bonus game" symbols appearing upon a wagered payline, etc. The bonus game, once actuated, generally consists of a separate game played on the display of a slot machine. For example, a player selects objects from a choice of objects offered, and receives coins or credits based upon the value of the objects revealed after the game is played. In other bonus games, an event is displayed for the player's amusement, and the player receives coins or credits based on the outcome of the event.

There have been bonus games where the play of the game determines one of several possible outcomes, such as those offered on IGT's Fort Knox Multi-Level Progressive games. In these games there is a plurality of progressive meters starting at different jackpot levels. The value of each meter is visible, and when a player reaches the bonus game, the results of the bonus game determine which of the four meter values is won by the player.

Players enjoy playing more exciting wagering games. The purpose of the present invention is to create attractions that enhance the play and enjoyment of a gaming machine so that it is more appealing to the player to play.

SUMMARY

In one aspect, an embodiment of the present invention may take the form of a method for operating a wagering game, comprising the steps of: (a) receiving a wager; (b) executing a game with a playfield having a tile base and a plurality of tile locations; (c) populating the tile locations of the playfield with tiles having differing subsets of symbols thereon, the tiles having a predetermined connection-path relationship to the tile base; (d) presenting a plurality of initially-hidden symbols; (e) receiving a selection of one of the initially-hidden symbols; (f) revealing the selected symbol; (g) determining according to a preset game methodology whether any of the symbols on the tiles in the playfield are in a matching relationship with the revealed selected symbol; (h) transforming the matching tiles on the playfield, the step of transforming including eliminating the matching tiles to thereby create an open space for the tile locations of the eliminated tiles; (i) after transforming the matching tiles on the playfield, removing from the playfield any remaining tiles that no longer have the predetermined connection-path relationship to the tile base; (j) repeating steps (e) through (i) for continued gameplay according to the game methodology; (k) evaluating the playfield for an outcome; and (l) presenting an award in the event that the outcome in the game merits an award according to the game methodology.

The playfield may have a top and a bottom, and the tile base may be located at the top. Removed tiles may appear to drop away and toward the bottom. Step (e) may comprise receiving the selection of one of the initially-hidden symbols from a human player. The award may be based on a furthest tile from the tile base. During play of the game, the progress of where the furthest tile from the tile base is on the playfield in the course of continued execution of step (j) can result in an award of decreasing or increasing value at step (k). And step (k) may include determining whether a positive outcome is achieved such that the playfield is repopulated for a next level of play, wherein the next level of play has an award greater in value than a current level.

In another aspect, an embodiment of the invention may take the form of a wagering gaming machine comprising: a video monitor; a cpu for operating the video monitor and other aspects of the gaming machine according to a gameplay methodology; a wager input device; and a player command input device that receives player selections, including player gameplay selections, in the course of gameplay. The gameplay methodology may generate a construct on the video monitor that changes in shape through increasing or decreasing in size along at least one dimension, a change in size being affected by a player's gameplay selection. The gameplay methodology may further evaluate an outcome based upon an aspect of the size along the at least one dimension, and provide an award, if any, in view of a predetermined outcome evaluation award format.

The video monitor may have a playfield generated thereon with a base defined on the playfield, where the player gameplay selections cause the construct to change in terms of a distance of a furthest point of the construct from the base, where the award format is predicated upon said distance. In an embodiment, it may be that upon gameplay initiation the construct is an array of interconnected objects, at least some of the objects being of differing quality. A player gameplay selection may result in elimination of objects of a certain quality from the array, and other objects which are no longer interconnected may also be eliminated. And the process of elimination may result in a decreased distance between the base and a now-furthest object from the base. The award format may be represented by a scale shown along the playfield related to distance from the base, the position of a furthest object along the scale determining an award, if any. Achievement of an award in a first gameplay may result in another gameplay with an opportunity to achieve an award of relatively greater value.

The objects may be in the form of tiles, which may be organized into subsets having differing indicia. The base may be at a defined top of the playfield. The tiles may be interconnected by a connecting relationship. A tile which is no longer connected to at least one other tile after a player gameplay selection may appear to fall away from the base. And the award format may be predicated upon the tile furthest from the base. The scale may include at least one decrease in award value and at least one increase in award value with increasing distance from the base. The player gameplay selection may comprise a player selecting from a group of initially-hidden tile indicia, a tile indicium being selected from said group thereby being eliminated from said array.

In another aspect, an embodiment of the invention may take the form of a method of operating a wagering game comprising the steps of: (a) receiving a wager; (b) presenting a playfield, the playfield comprising a tile base and a plurality of tiles, each tile being initially connected to at least one of the tile base and one or more other tiles, each tile being one of a plurality of tile types; (c) presenting a tile-type-selection area, the tile-type-selection area comprising one or more initially-hidden tile types; (d) receiving a selection of an initially-hidden tile type, and responsively revealing that tile type; (e) updating the playfield by (i) removing any tiles thereon having the revealed selected tile type and (ii) removing any additional tiles thereon that, as a result of removing the tiles having the revealed selected tile type, then do not have a connection path to the tile base; (f) repeating steps (d) and (e) so long as each condition in a set of conditions is satisfied, wherein the set of conditions comprises: (i) at least one initially-hidden tile type is still hidden and (ii) at least one tile remains on the playfield; (g) evaluating the playfield for an outcome; and (h) presenting an award based on the outcome.

This method may be carried out as a bonus game in response to a predetermined triggering event in a base game. The playfield may have a top and a bottom, where the tile base is located at the top of the playfield, and where removing any tiles as part of at least one of step (e)(i) and step (e)(ii) comprises animating any removed tiles to give the appearance that the removed tiles are falling towards the bottom of the playfield. Each tile type may be defined by at least one of a different symbol and a different color.

The method may further comprise carrying out multiple iterations of steps (b) through (g), where each iteration is associated with a different award, which could be a different progressive jackpot or a different tangible good, as examples. The set of conditions in step (f) may further comprise: (iii) a player has not yet input an indication that the player has decided to stop picking tile types from the tile-type-selection area.

The playfield may include a plurality of zones, and step (e) may comprise identifying in which zone a then-furthest tile from the tile base is located, where the zones are respectively associated with different awards, such as different progressive jackpots or different tangible goods, as examples. At a first point in time during play of the game, the then-furthest tile from the tile base may be located in a first zone associated with a first award. At a second point in time during the play of the game, the then-furthest tile from the tile base may be located in a second zone associated with a second award. The second point in time may occur after the first point in time, and the second award may be less valuable than the first award. At a third point in time during play of the game, the then-furthest tile from the tile base may be located in a third zone associated with a third award. The third point in time may occur after the second point in time, and the third award may be more valuable than the second award.

The addition of an exciting and entertaining bonus game can be a great enhancement to playing a wagering game in a casino environment. It is a principal objective of the present invention to create features of a bonus game that enhance the participation and enjoyment of a gaming machine, so that it is more appealing to the player to play.

One object of the present invention is to provide a bonus game that is based on player selection affecting the outcome of the bonus game. It is further contemplated that elements of skill may affect the bonus round outcomes.

Another object of the present invention is to provide a bonus game with shared bonus progressive awards. The players compete for the progressive award during the bonus game.

Yet another object of the present invention is to create a new kind of bonus round which may be used in a standard way to provide a credit award or to result in the selection of one of a group of awards.

Another object of the present invention is to create a new kind of bonus round which awards credits and, in some cases, additionally awards one of a group of awards.

It will of course be understood that the aspects and objectives of the invention are various, and need not be all present in any given embodiment of the invention. The features, advantages and accomplishments of the invention will be further appreciated and understood upon consideration of the following detailed description of an embodiment of the invention, taken in conjunction with the drawings.

Yet another object of the present invention is to create a new game, not used just in a bonus capacity, where the game operates on the basis of a two-dimensional structure that changes in the course of the game, with an award dependent upon some "physical" aspect of the structure at an evaluation stage, e.g., the height of a stack of blocks. The game can further use progressive (i.e., multi-level) operations of construction/deconstruction of structures to advance to ever more valuable prizes. The prizes may further go up and down in value or kind as the structure changes.

These as well as other aspects and advantages will become apparent to those of ordinary skill in the art by reading the following detailed description, with reference where appropriate to the accompanying drawings.

BRIEF DESCRIPTION OF THE DRAWINGS

Various examples of embodiments are described herein with reference to the following drawings, wherein like numerals denote like entities.

DETAILED DESCRIPTION OF THE DRAWINGS

It should be understood that the arrangements described herein are set forth only as examples. Those skilled in the art will appreciate that other arrangements and elements (e.g., machines, interfaces, functions, orders, and groupings of functions, etc.) can be used instead, and that some elements may be omitted altogether. Further, many of the elements described herein are functional entities that may be implemented as discrete or distributed components or in conjunction with other components, and in any suitable combination and location. Various functions described herein as being performed by one or more entities may be carried out by hardware, firmware, and/or software. Various functions may be carried out by a processor executing instructions stored in memory.

Figure 1:
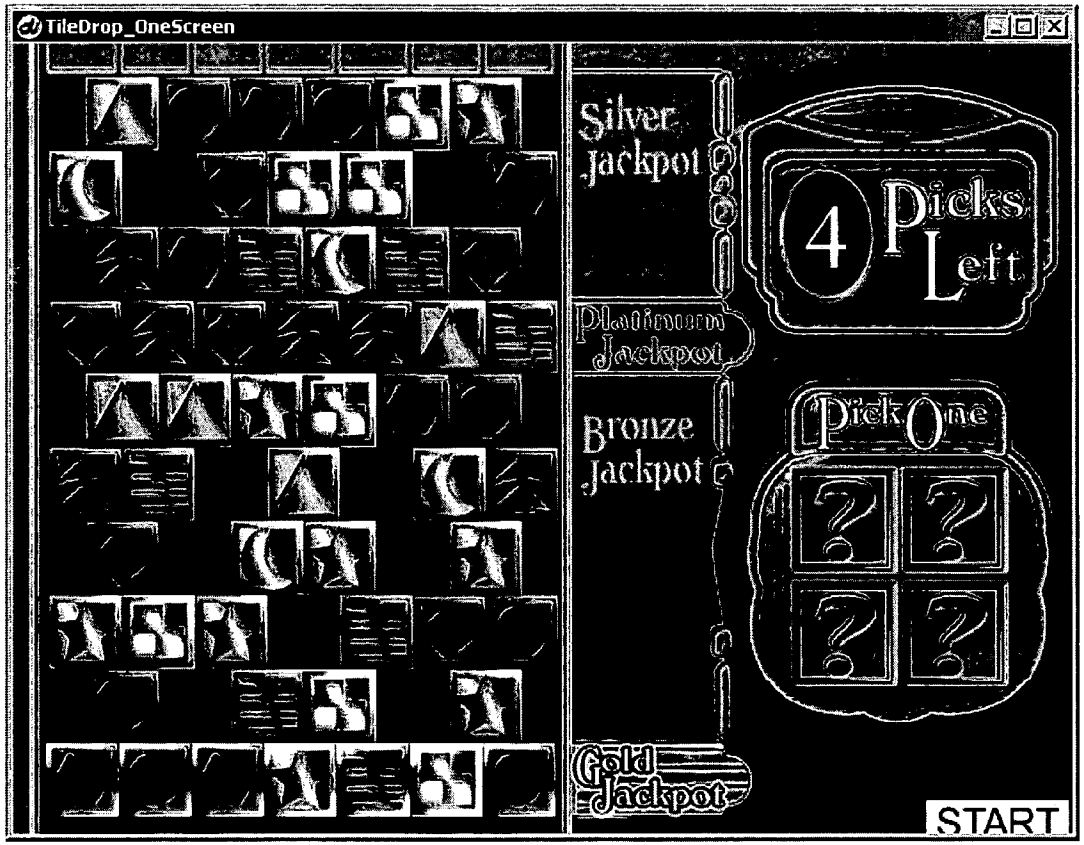
FIGS. 1-7 and 9-20 depict various screenshots, in accordance with exemplary embodiments.

FIG. 1 shows one embodiment of the invention. The game of FIG. 1 has square tiles on the playfield. The tiles in FIG. 1 are all the same size and shape, although other different sizes and shapes may be used as well, as could a mixture of sizes and shapes, without departing from the invention. FIG. 1 shows fifty-six tiles that each carry one of nine different symbols from a set, although more or fewer tiles and/or symbols could be used. Each symbol has a unique insignia and color. It is contemplated that any set of differing symbols could be used without departing from the invention. Since each tile carries a symbol as an aspect of the invention, the terms "tile" and "symbol" are used interchangeably herein.

At the start of the game, a plurality of tiles are placed on the playfield. The playfield can be a game board, video screen, touch display, game grid or any area the game is played. The tiles are arranged such that each symbol is "connected" to at least one other symbol and/or to the "symbol base". The symbol base of this embodiment is the seven tiles, without symbols, at the top of the playfield. In FIG. 1, the tiles of the symbol base are all touching, or connected; however, the symbol base could appear anywhere on the screen and in any arrangement, or configuration, without departing from the invention.

Each tile could be connected to another tile or to the tiles of the symbol base, as shown in FIG. 1. Each tile is connected to, or touching, another tile if at least a portion of one edge of one tile contacts or mates with at least a portion of another edge of another tile. The connection could also be overlapping, or make use of any other connecting means, such as a line from one tile to another. In this embodiment, the tiles are arranged in rows, wherein each row is offset from the row above or below by one half of a symbol width. This allows any tile to be connected, or touching, up to six other symbols: the two neighbors on the same row, the two neighbors from the row below, the two neighbors from the row above. Any other arrangement of tile "connections" may be used without departing from the invention.

In this embodiment, the game starts with a connection path from each tile to the symbol base. That is, a symbol is said to be on a connection path if it is either connected to the symbol base or connected to a symbol that is connected to the symbol base, via any number of connection paths. It is contemplated that, at the start of the game, certain symbols are not on a connection path, and once these symbols are revealed, they are removed because they do not possess a connection path to the symbol base.

In this embodiment, the game software simulates the connection of tiles as if they were glued together and hanging from the symbol base. Therefore any symbol that is not on a connection path will fall as if from the force of gravity. Unconnected symbols are animated downward to simulate this physical condition.

While the present invention shows a symbol base on the top, with tiles appearing to hang downwardly by gravity (and thus falling when they no longer have a connection path to the symbol base), the playfield could take on many other configurations. For example the symbol base could be a rectangle in the center of the playfield with tiles attached to each side of the symbol base. Alternatively, the symbol base could be a circle in the center of the playfield, with connected tiles radiating outward from the symbol base. The symbol base could also consist of multiple positions, such as the four boundaries of the playfield, or individual islands on the boundaries. These are only a few examples, as many possibilities will come to mind to those skilled in the art.

After the initial game board is revealed, the player is presented with an initially-hidden subset of the set of nine possible symbols, in the form of a "Pick One" selection box, which is positioned outside the playfield. Referring to FIG. 1, the player is presented with four squares showing question marks. Four of the nine symbols are offered for player selection in the selection box, although any number could be used that would allow a desired mathematical distribution of the results. Each question mark hides a symbol.

Figure 2:
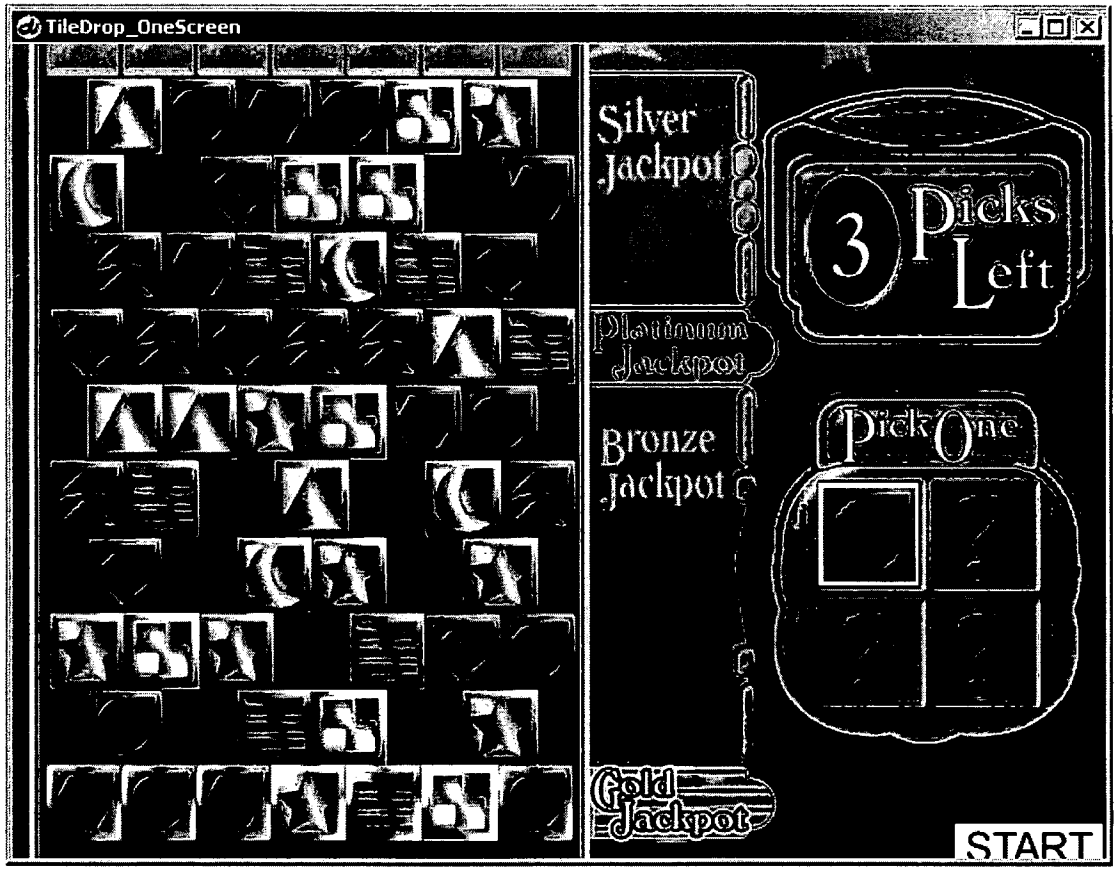

The player selects one of the four squares, revealing the symbol thereunder, as shown in FIG. 2. This selection could be made by touching the selected question mark graphic on a touch-screen display as is well known in the art. The selection could also be made by the press of a button or other input mechanism, such as the keyboard on a server-based or internet gaming device. In this example, the player selected the upper left question mark, which revealed the red-circle symbol, as shown in FIG. 2. The seven tiles matching the red-circle symbols are removed from the playfield. After each symbol is removed, any remaining symbols that are no longer on a connection path to the symbol base (such as the pink-hexagon symbol located in the lower left) are animated to move downwardly as if they are falling, because they are no longer on a connection path to the symbol base. The tiles could be removed in different manners, such as one at a time, all at once, or from bottom to top. As such, the tiles can be animated to drop after all matching tiles are removed, or as each matching tile is removed, or in any other desired or entertaining fashion.

Figure 3:
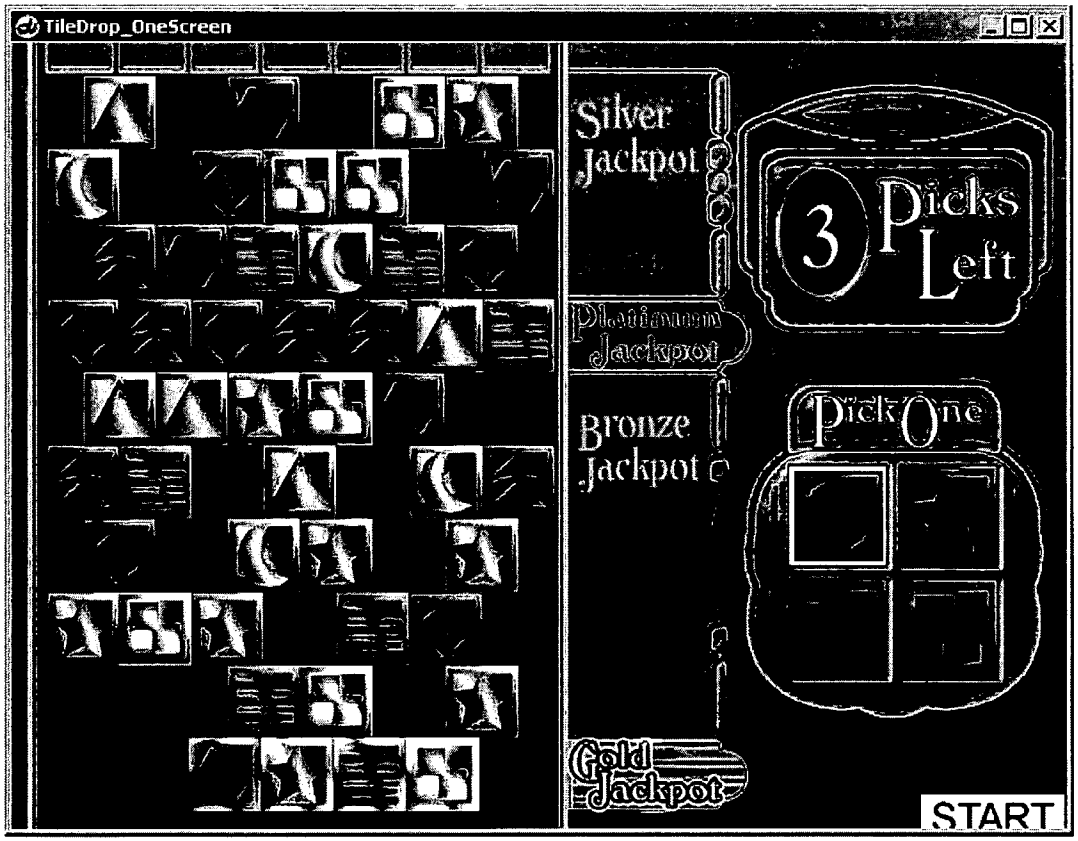

FIG. 3 shows the game board of FIG. 2 after the seven red-circle symbols have been removed and the pink-hexagon piece has fallen as a result of that action, as described above. In FIG. 3, the selection box reveals the symbols that were available for selection but not chosen; in this case a silver-star symbol, an orange-horizontal-lines symbol and a yellow-squares symbol.

As an aside, it should be noted that different award configurations could be implemented in connection with different embodiments of the invention. This embodiment begins with a tile configuration and, at each step of the game, various tiles are removed. The game could be configured to award credits for each tile that is removed from the game. Or the game could be configured to award the player credits for the tiles that remain. The award values for remaining or removed tiles could be the same for each tile or could vary based on the symbol or even based on the position in the game grid. Any award structure could be used, and the structure could change as the game progresses, without departing from the invention.

In this example, the award is based on the configuration of the remaining tiles. Referring to FIG. 1, off to the right side of the playfield, there are designators which divide the playfield vertically into four award fields, or areas. In this embodiment, from the top down, these are called Silver Jackpot, Platinum Jackpot, Bronze Jackpot and Gold Jackpot. These could be associated with any awards, but in this example each is tied to a progressive award meter which shows a cash—or credit—value that increases with each play of the game until a player wins it. An example of the reset—or initial—value of these progressive awards, in order from highest to lowest, could be:

| | |
|---|---|
| Silver Jackpot = | $20 |
| Platinum Jackpot = | $1000 |
| Bronze Jackpot = | $8 |
| Gold Jackpot = | $100 |

In the example shown here, the player is given four rounds of picking a symbol and removing matching symbols, as well as removing the tiles that do not have a connection path to the symbol base. Four rounds are used in this example, to provide a reasonable length of play for the player, as well as to allow for the distribution of the results to fall in a desired range, although any number of rounds may be used without departing from the invention. Furthermore, the game could be played where some of the awards are not available on every round of the game without departing from the invention. The game could also be configured to allow the player to decide when to stop picking symbols, or could require all rounds to be played, as in this example.

After the fourth player selection, an award is determined based on the configuration of the remaining tiles in the playfield. At the end of all player selections and the removal of tiles without a connection path, the award is determined by the position of the lowest remaining tile(s). At the end of the first pick, as shown in FIG. 3, the lowest remaining symbol(s) are positioned at the Gold Jackpot award area. The Gold Jackpot logo shows animated highlights to emphasize the relationship of the low tiles and the award. If any of the four symbols in this award area still remain at the end of the game, then the player would win the Gold Jackpot progressive award.

Figure 4:
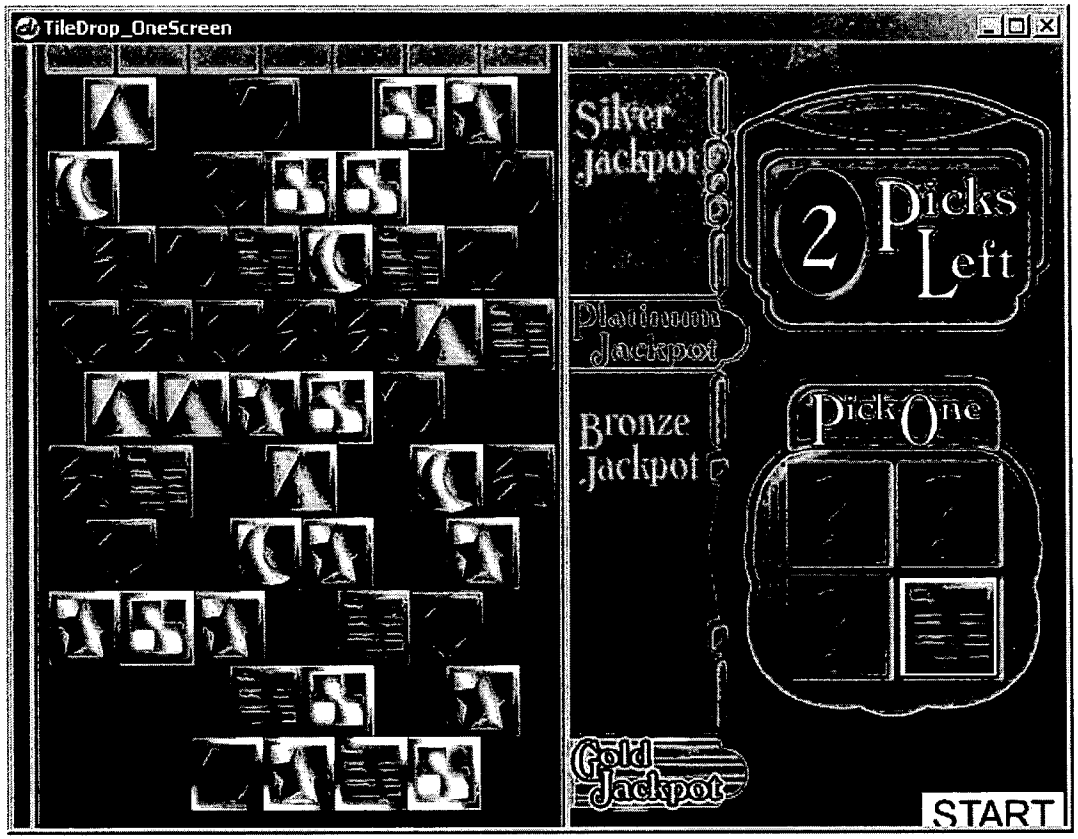

In FIG. 4, the player has selected the lower right question mark, which reveals the orange-horizontal-lines symbol. The seven matching symbols on the playfield are removed, as well as the pink-hexagon symbol and silver-star symbol on the lowest row, and the yellow-squares symbols on the next row up, since these tiles no longer have a connection path to the symbol base.

Figure 5:
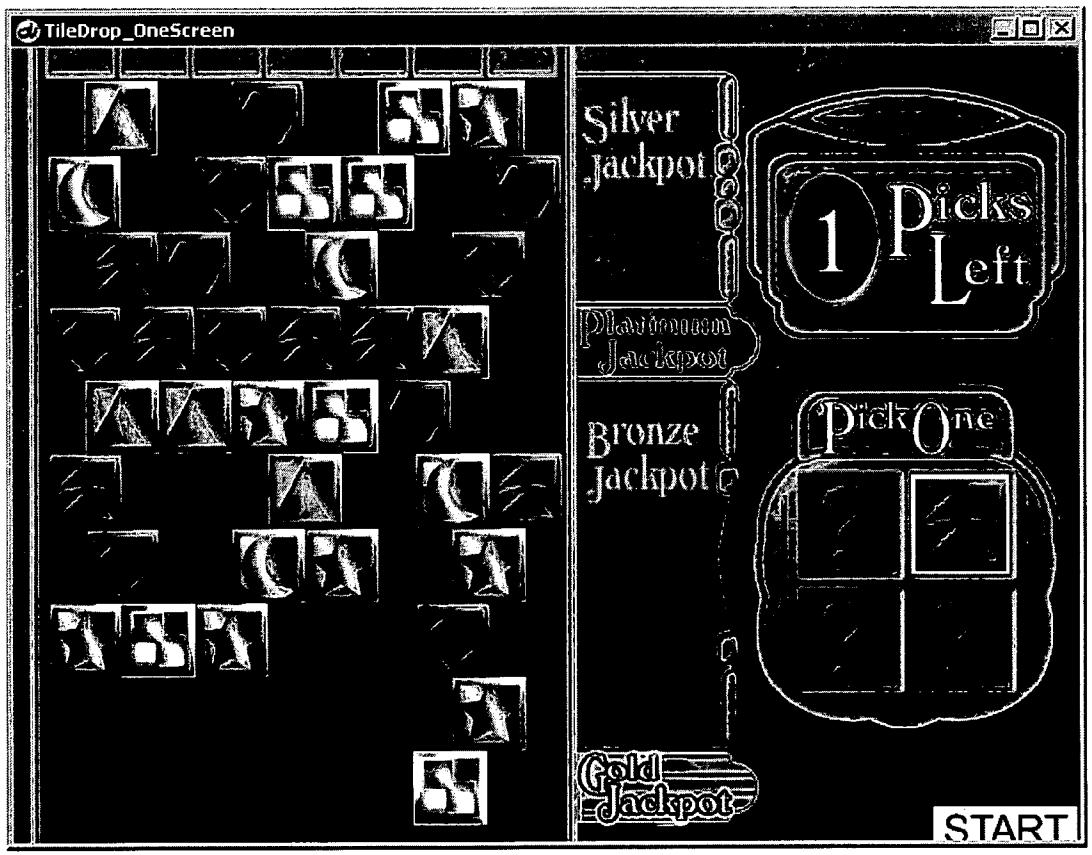

This results in the playfield of FIG. 5, where the purple-arrows symbol is selected as the third pick, in the upper right corner of the "Pick One" selection box. The six purple-arrows tiles are removed, which hollows out the playfield quite a bit; but no tiles lose a connection path in this example. The lowest tile is a yellow-squares tile on the bottom row, leaving the player qualified for the second highest progressive award at the Gold Jackpot award area.

Figure 6:
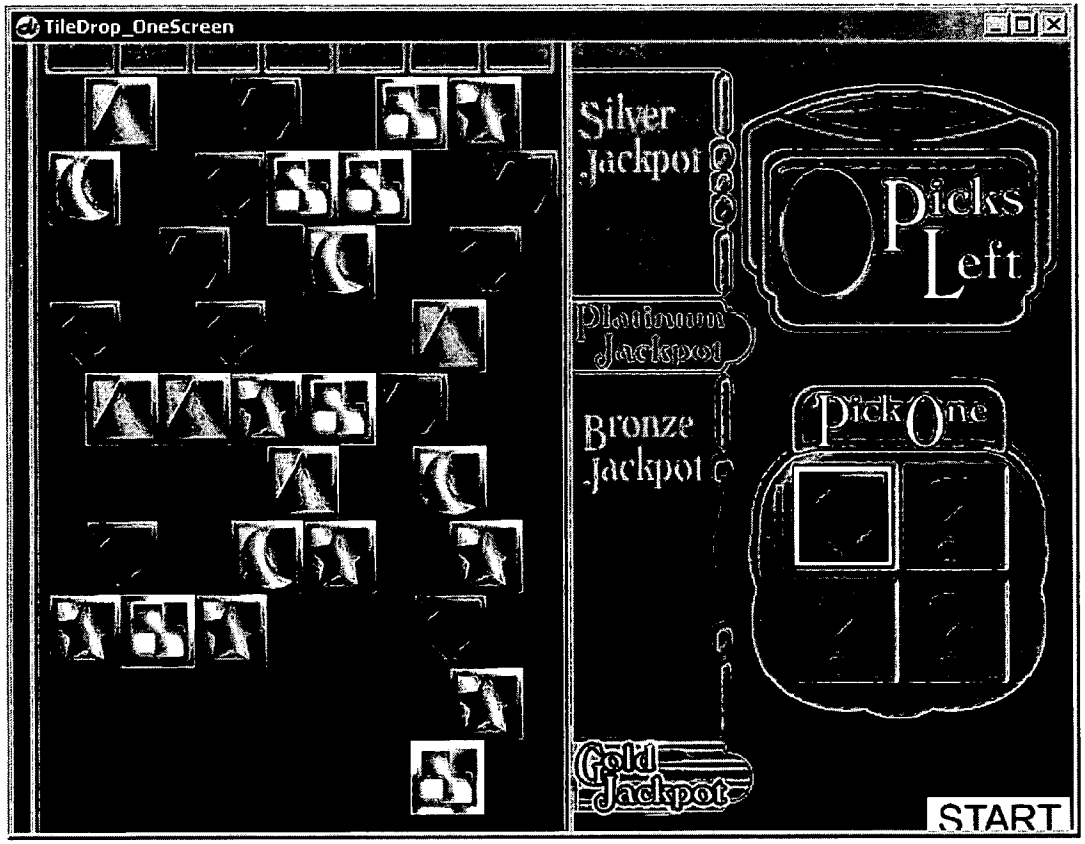

FIG. 6 illustrates the playfield with one selection remaining. The lowest tile is positioned in the Gold Jackpot award area. If the symbol that the player picks next were the green triangle, then tiles would remain positioned in the Gold Jackpot award area, and the player would win the Gold Jackpot progressive award. If the player picked one of the cyan-moon symbol, the yellow-squares symbol, or the silver-star symbol, the lowest tile would be positioned in the Bronze Jackpot area after the removal of unconnected tiles. In this example, there is no tile whose removal would leave the lowest tile positioned in the Platinum Jackpot award area. In this embodiment, there is a combination of picks from the start of the game that could have resulted in a lowest tile positioned in the Platinum Jackpot area (Purple Arrows, Blue Diamond, Pink Hexagon and Red Circle), but the first three picks eliminated this possibility.

In FIG. 6, a final selection of the pink hexagon or blue diamond will result in a lowest tile positioned in the Silver Jackpot award area. FIG. 6 shows the selection of the blue diamond in the upper left corner of the "Pick One" selection box.

Figure 7:
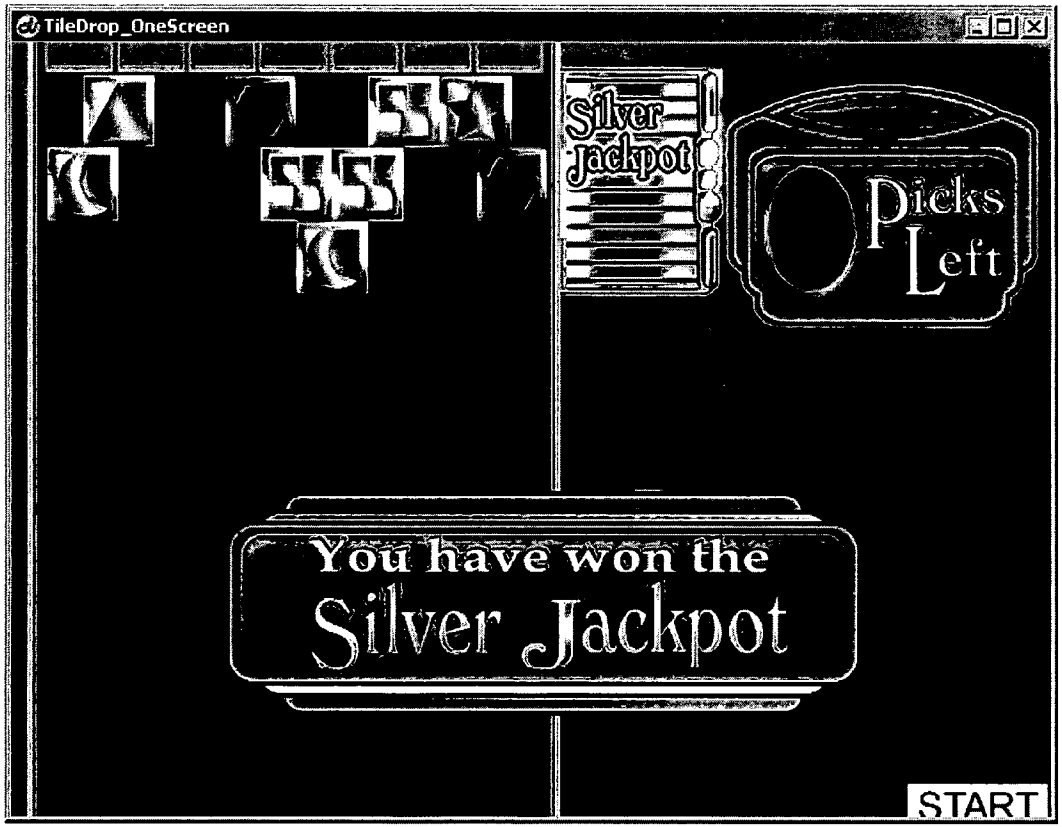

FIG. 7 shows the playfield after the six blue-diamond tiles have been removed, as well as tiles that no longer had a connection path to the symbol base. When no remaining tiles are positioned within an award area of the progressive award meter, the award areas are removed entirely, in this embodiment. As shown in FIG. 7, the Silver Jackpot award area is highlighted and would be animated in this embodiment. FIG. 7 shows the lowest tile positioned in the Silver Jackpot award area of the progressive award meter, such that the player wins the Silver Jackpot progressive award at the end of the game.

Referring back to FIG. 1, the game begins with a playfield with tiles positioned in the second highest award area, the Gold Jackpot. As tiles are removed, tiles move into the Bronze Jackpot area, which is the fourth highest award, with hopes of achieving the Platinum Jackpot (the highest award). If the player overshoots, the Silver Jackpot is won, which is the third highest award. Unlike other bonus games that typically start with a low result and play of the bonus game improves the result, the present invention starts with a high bonus award, where the player tries to maintain it throughout the game, or tries to improve the result if a low award is obtained during play of the game.

In the example above, there are four progressive jackpot awards associated with the four vertical designation areas of the award meter. The award meter could be implemented on the display, or screen, of an individual gaming machine or, more conveniently, meters that are external to the gaming machine, for example, overhead. External meters for progressive awards are typically shown on LED, LCD, Plasma or other displays and are well known in the art.

A more exciting approach is to link a group of games together with the play of each machine in the group contributing to one or more progressive meters. In a typical group progressive game, the gaming machines are positioned as a group with an external overhead display of progressive jackpot meters. When a progressive jackpot is won by any player in the group, the meter for that jackpot is reset to a fixed or variable reset value as is well known in the art. Subsequent play is for the new value.

Figure 8A:
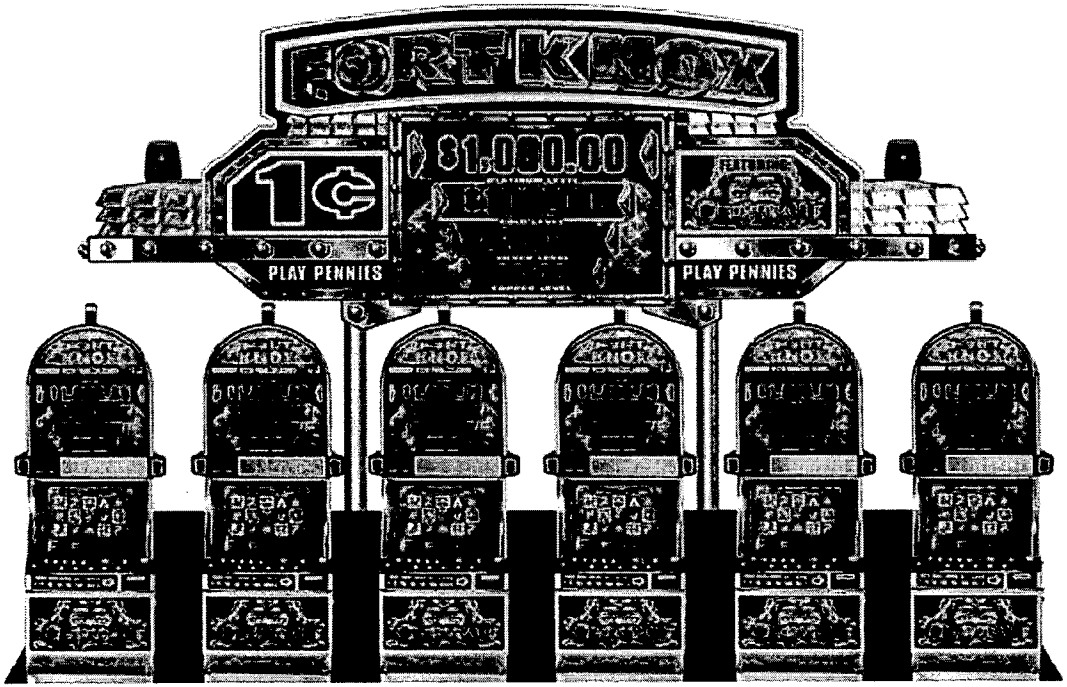
FIGS. 8*a* and 8*b* depict exemplary arrangements of gaming machines, in accordance with exemplary embodiments.

A group progressive game may have all gaming machines positioned in the same location as shown in FIG. 8*a*. A group progressive game could be linked to multiple games or groups of games in different physical locations in one facility or in separate facilities via Wide Area Networking (WAN) technology that is well known in the art. Multiple machines may also be networked into a progressive system using server-based gaming technology, which could operate in a physical play area or areas, or over the internet in the form of internet gaming. Progressive awards (as well as this game without progressive awards) could also be offered on wireless hand-held devices using mobile gaming technology.

Figure 8B:
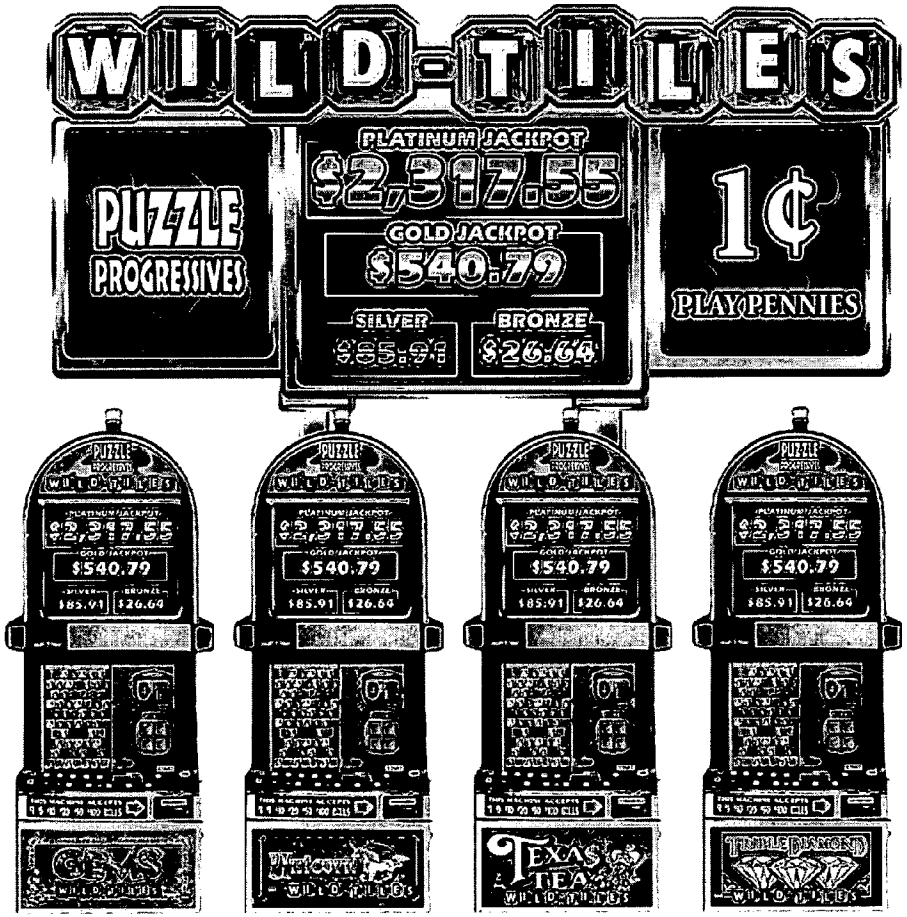

The group of games connected to the group progressive could all use the same base game theme as is seen in FIG. 8*a* or alternatively the games connected to the group progressive could be different themes as shown in FIG. 8*b*. In addition to the bonus game of the present invention, any of the games may have other bonus games (usually related to the theme of the game) which play as a result of different trigger conditions.

While there are many ways to combine multiple games with a progressive award system, the present invention can provide any type of award, and progressive jackpots are only one example. The bonus round of this invention could be configured to give out merchandise, such as logo clothing, casino and hotel amenities, or diamond jewelry, just to name a few. Having exactly four award types is also only a representative example, as there can be more or fewer awards available without departing from the invention.

Figure 9:
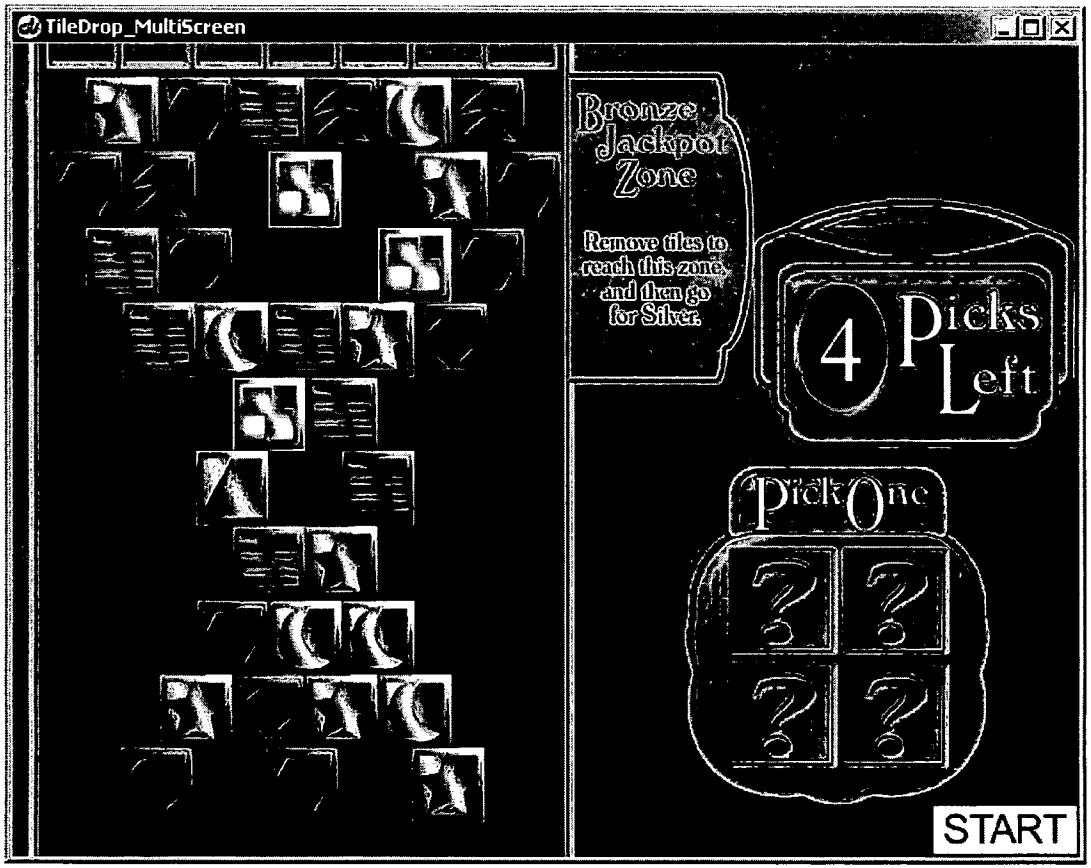

In another embodiment of the invention, the player plays successive rounds of the game, attempting to win a more valuable prize in each round. FIG. 9 shows an embodiment of a bonus game with successive rounds, where being able to play each subsequent round is earned by a win in a current round. The bonus game may be initiated by any means. Some bonus-game-initiation criteria that are known in the art include a combination of symbols on the reels of a mechanical reel or video slot machine, a secondary random event generated by the game or external system, a certain total amount of money wagered (which may or may not be an amount that is known to the player), either fixed in value or randomly chosen, just to name a few. It is not important what criteria are used for the bonus-game initiation, as long as the combination of the frequency and expected return of the bonus game deliver a desired payout percentage. The combination of acceptable frequency/expected return is well known in the art.

As shown in FIG. 9, the player is playing for one of four progressive Jackpots, in decreasing order of expected value: Platinum, Gold, Silver, Bronze. In this embodiment, the player always wins one of the four jackpots as a result of the bonus-game criteria that initiated the bonus game. It is contemplated, however, that other embodiments may be configured so that the player does not always win one of the awards in the bonus game. For example, in this embodiment or in any other disclosed herein, a certain selection of symbols could result in all tiles falling away, leaving the player without an award. Or a certain zone corresponding to the lowest-hanging tile—or more generally the tile furthest from the base—could be associated with a lack of an award for the player. And many other examples are possible as well, without departing from the invention.

The player has four picks, or selections, in the "Pick One" selection box for each round of the bonus game, and may play up to four total rounds in this embodiment. In each successive round, the player is playing for the next higher jackpot. In FIG. 9, the player begins by playing for the Bronze Jackpot. If after the player pick in this bonus game, all symbol(s) are positioned in the vertical award area of the "Bronze Jackpot", then the player wins the Bronze Jackpot award. Since this example always awards one of the four jackpots, the tiles for this round are configured such that any combination of four picks from the selection box will result in all tiles left in the Bronze Jackpot area. The tile arrangement and picks available would be set up differently if it was desired to not pay out a jackpot every bonus round. The arrangement of the tiles and picks is discussed more fully below.

Figure 10:
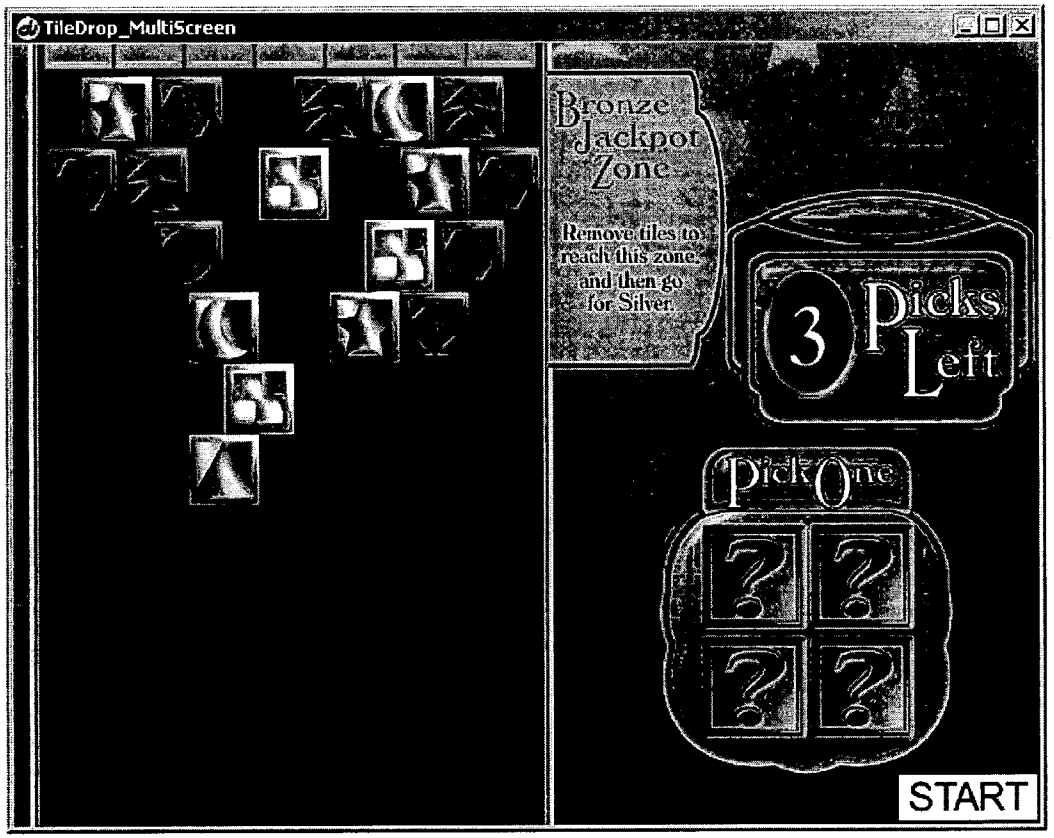
Figure 11:
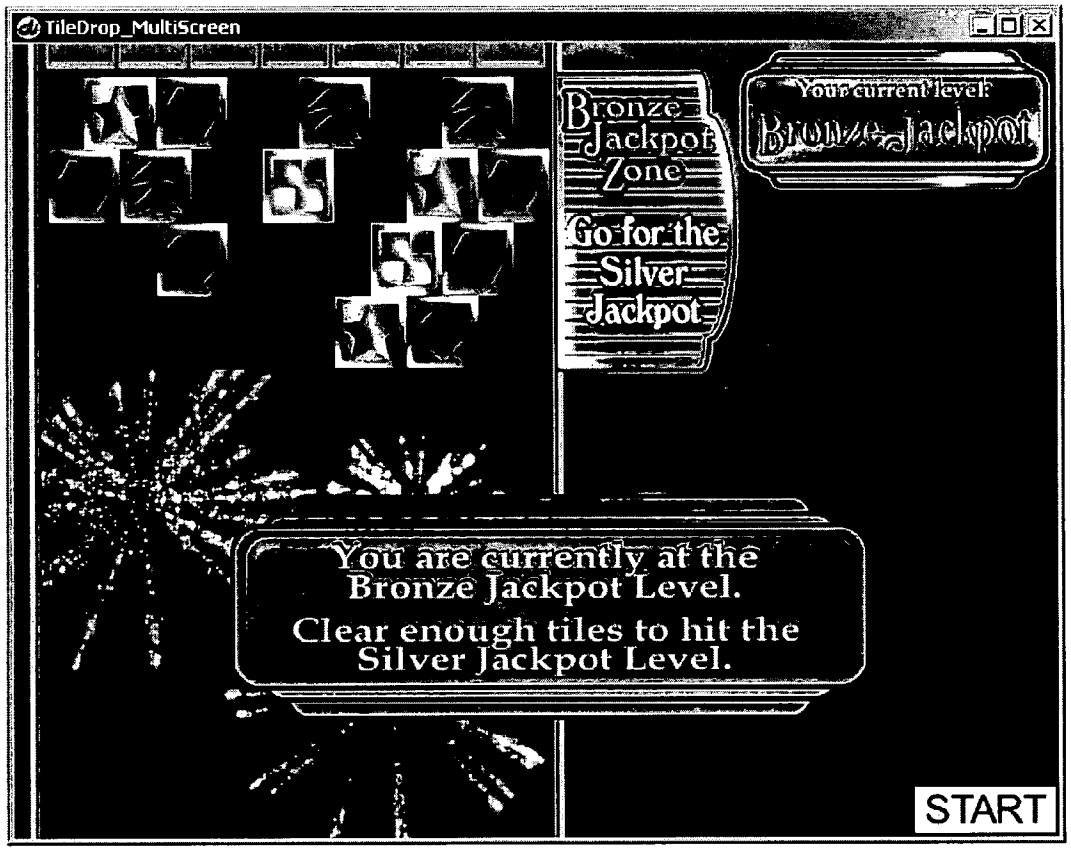

FIG. 10 is the result of the selection of the orange-horizontal-lines symbol. The seven matching symbols are removed from the playfield, and other tiles without a connection path are removed by having them fall off of the playfield. The player has not yet won the Bronze Jackpot due to the two tiles that remain positioned below the Bronze Jackpot area. In this example, the player next picks the cyan-moon symbol from the selection box. After removal of the two matching symbols, the player now wins the Bronze Jackpot, as a result of all of the symbols being positioned in the Bronze Jackpot area, as seen in FIG. 11.

In one embodiment, the player gets a choice on whether to keep the Bronze Jackpot award or to risk it to go on to try for the Silver Jackpot award. Another embodiment would let the player keep each jackpot won in each round, or sequence, of play. In this embodiment, however, the player is trying to "move up" to the Silver Jackpot award. If the player wins the Silver Jackpot on the next round, then the player will trade the Bronze Jackpot for the Silver Jackpot, and then subsequently go for the Gold Jackpot. If the player does not win the Silver Jackpot, the player would keep the Bronze Jackpot. And other examples are possible.

Figure 12:
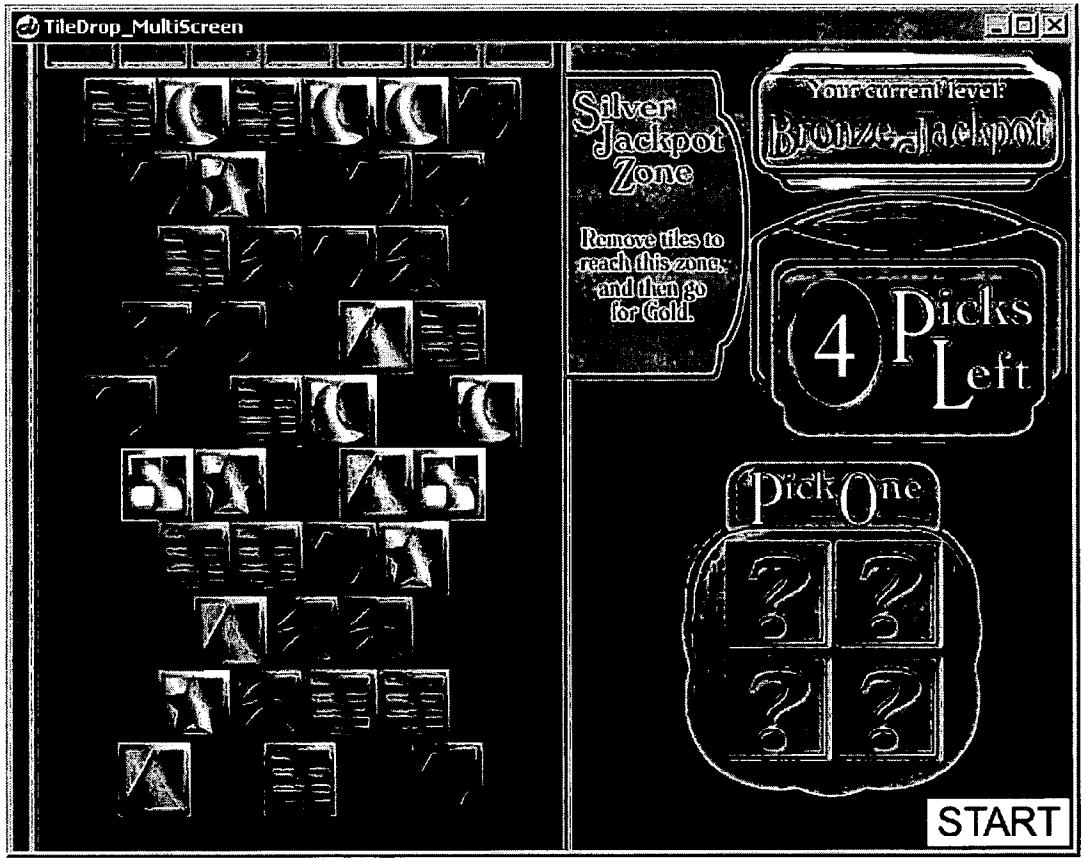

FIG. 12 shows the beginning of the second round of the bonus game. The player again has four picks to try to remove tiles to win the Silver Jackpot award. In this example, each round begins with four picks. Alternatively, the player could start with a total number of picks for the entire bonus game that can be carried over round to round. Alternatively, unused picks from one round can be carried over for each subsequent round (which in this example would add the two unused picks from round one to the four picks provided in round two for a total of six picks). It is not important how the picks are managed as long as tiles are selected to alter the playfield and the probabilities of winning the different awards are in an acceptable range, as is well understood in the art. There could even be a skill-based version, where the player examines the tile arrangement and then picks the tile to be removed on a touch screen, or the player and gaming machine could take turns selecting tiles. Again, many examples are possible without departing from the invention.

Figure 13:
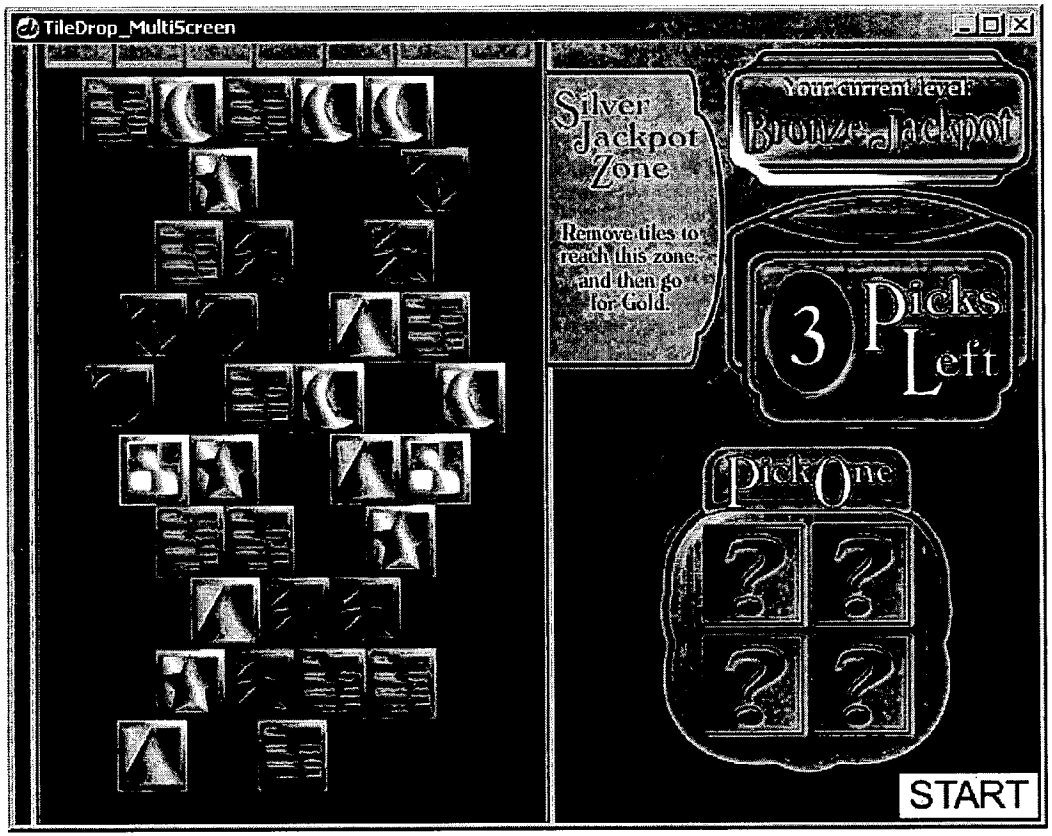
Figure 14:
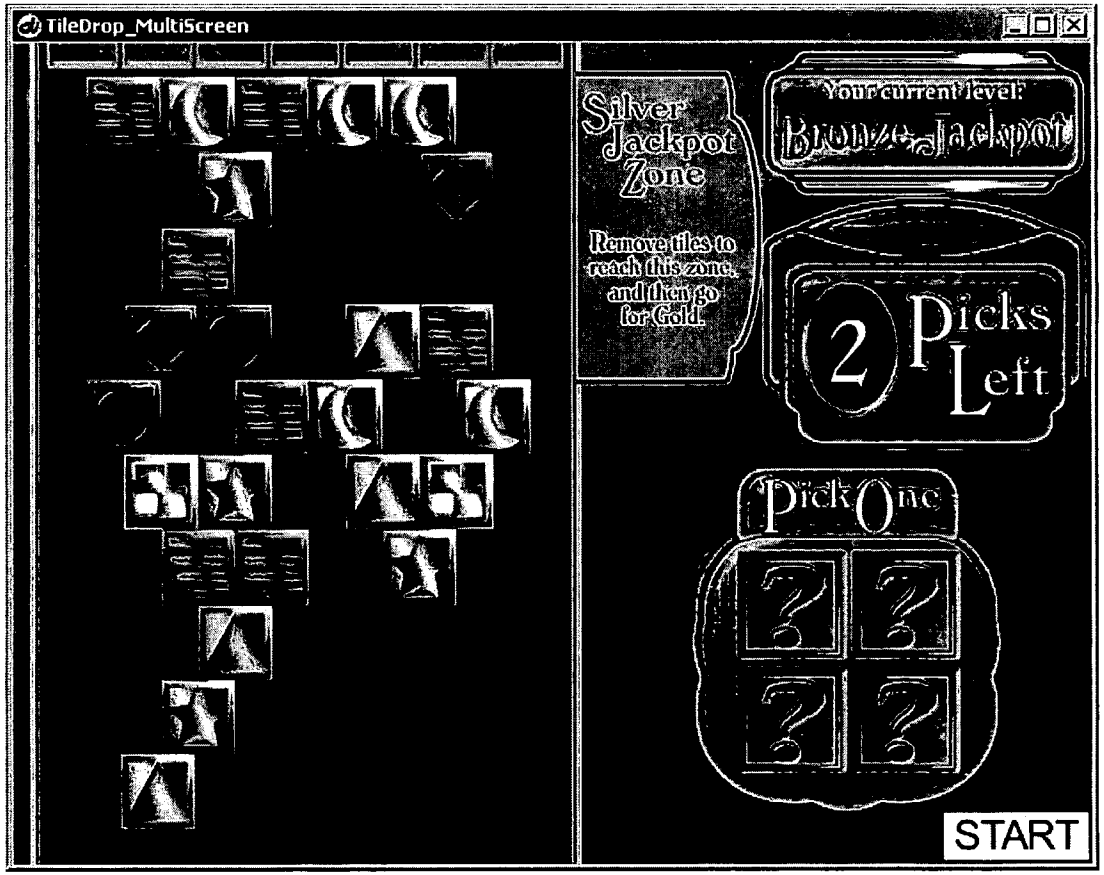

FIG. 13 shows the playfield after the pink-hexagon symbol was selected from the selection box, causing the six matching tiles to be removed. FIG. 14 shows the next pick of the purple-arrows symbol from the selection box. This pick causes the five matching purple-arrows symbols to be removed, and the three orange-horizontal-lines symbols that no longer have a connection path as a result thereof.

Figure 15:
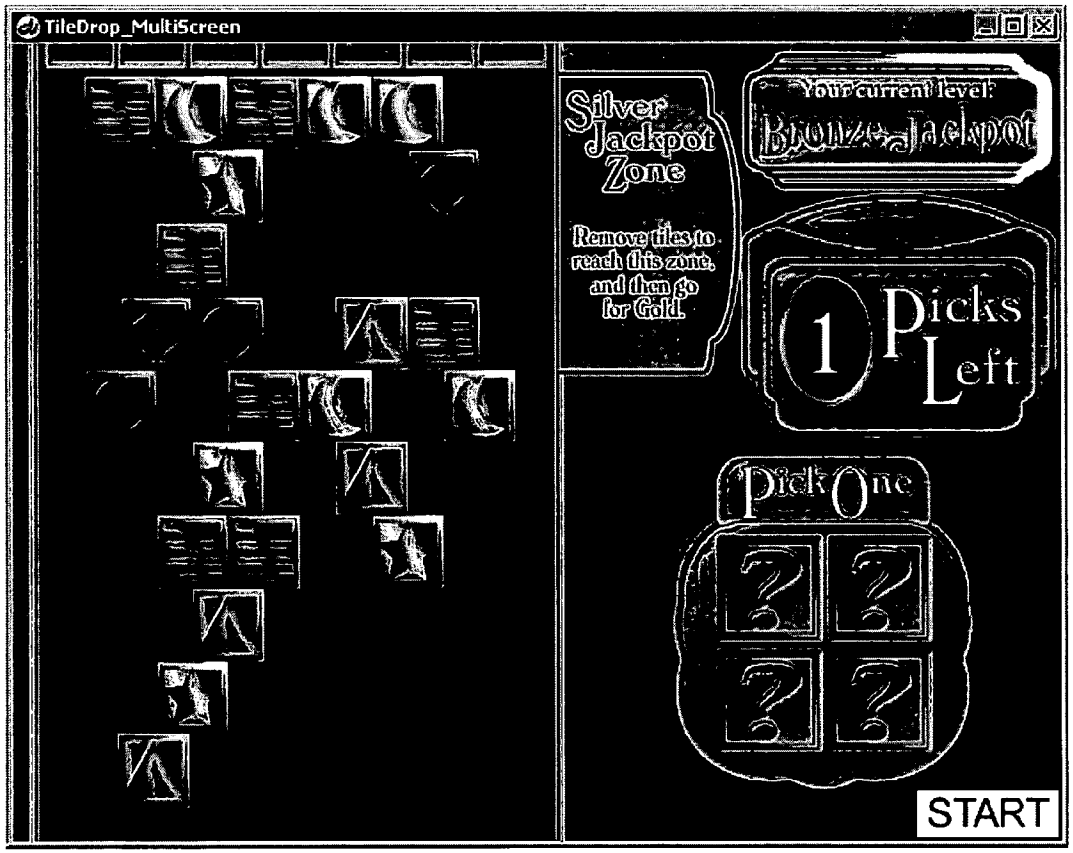
Figure 16:
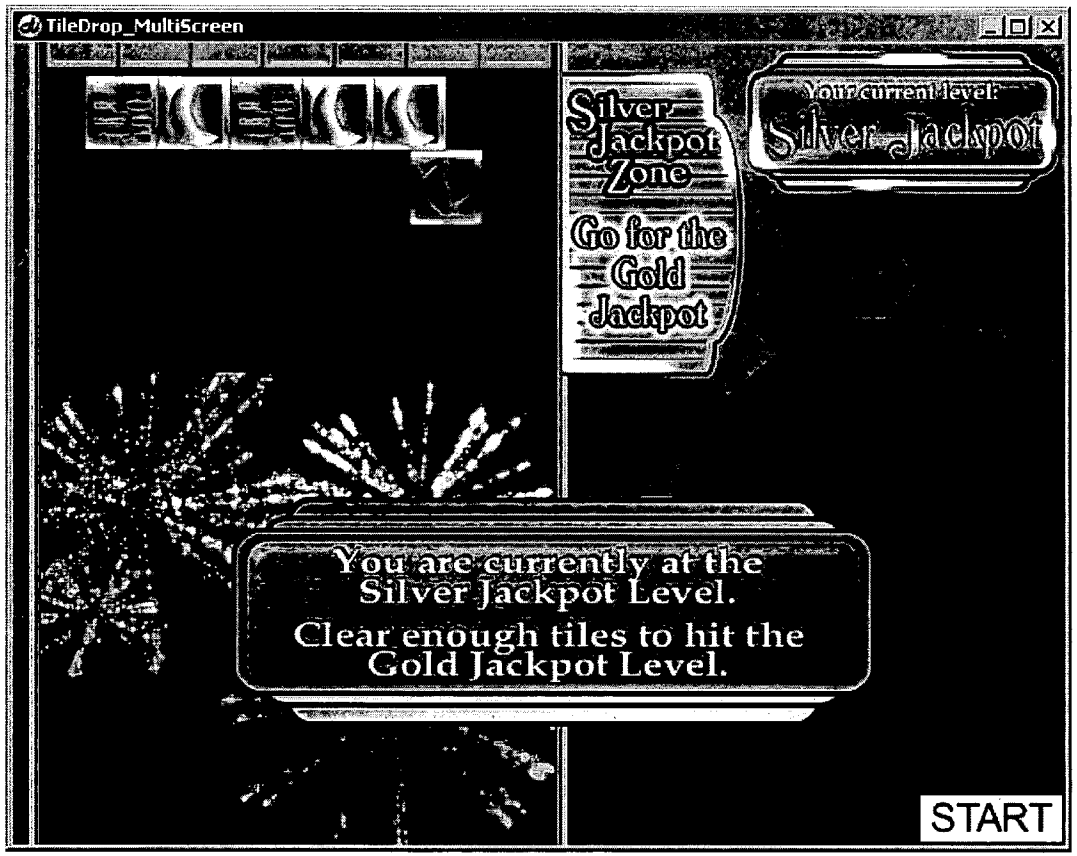

FIG. 15 shows the result of the playfield after the player selected the yellow-squares symbol. The two matching tiles are removed from the playfield, which was of no help in removing tiles to be positioned in the Silver Jackpot area. On the next pick, the player is shown having selected the silver-star symbol. Selecting this symbol leaves most of the tiles with no connection path to the symbol base. These tiles all "fall off" the playfield, leaving the remaining six pieces positioned well within the Silver Jackpot award area as shown in FIG. 16. The player has now achieved the Silver Jackpot and the third round of the bonus game commences. If the second round described above ended with tiles below the Silver Jackpot area, the player would have been awarded the Bronze Jackpot award and the bonus game would have ended.

Figure 17:
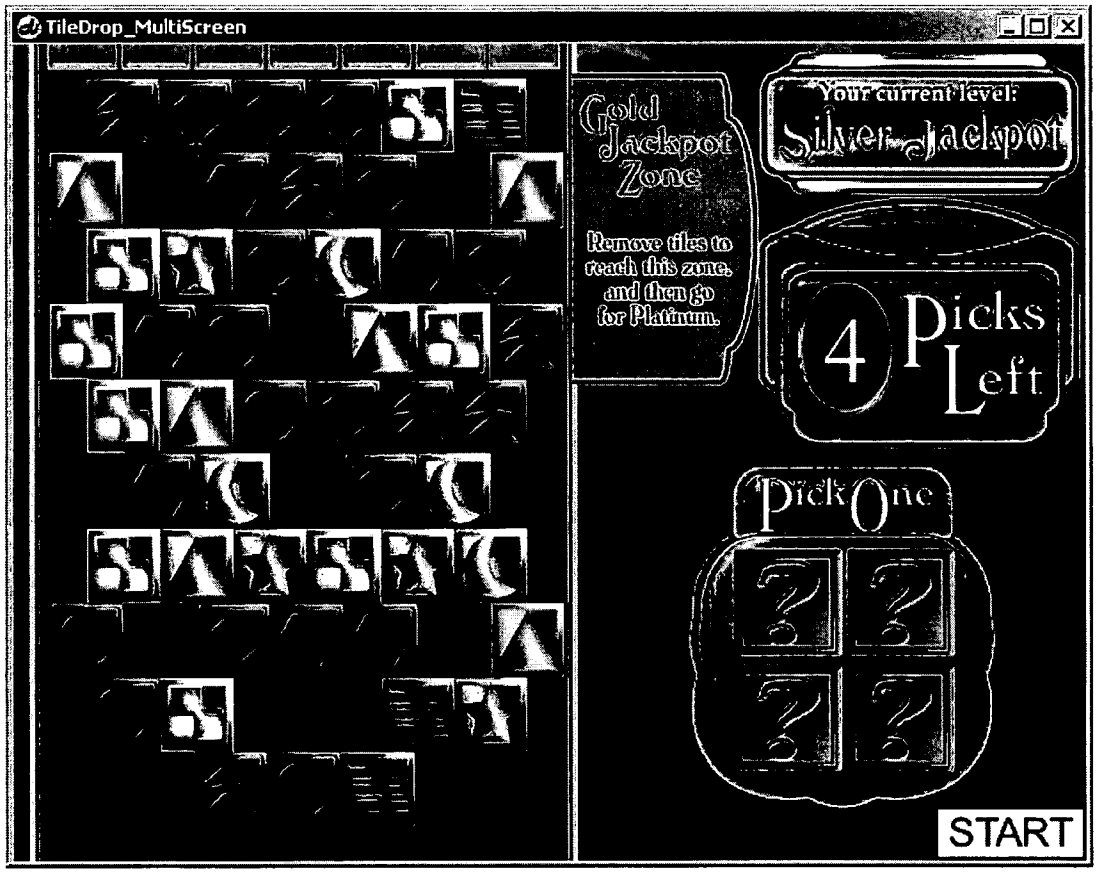
Figure 18:
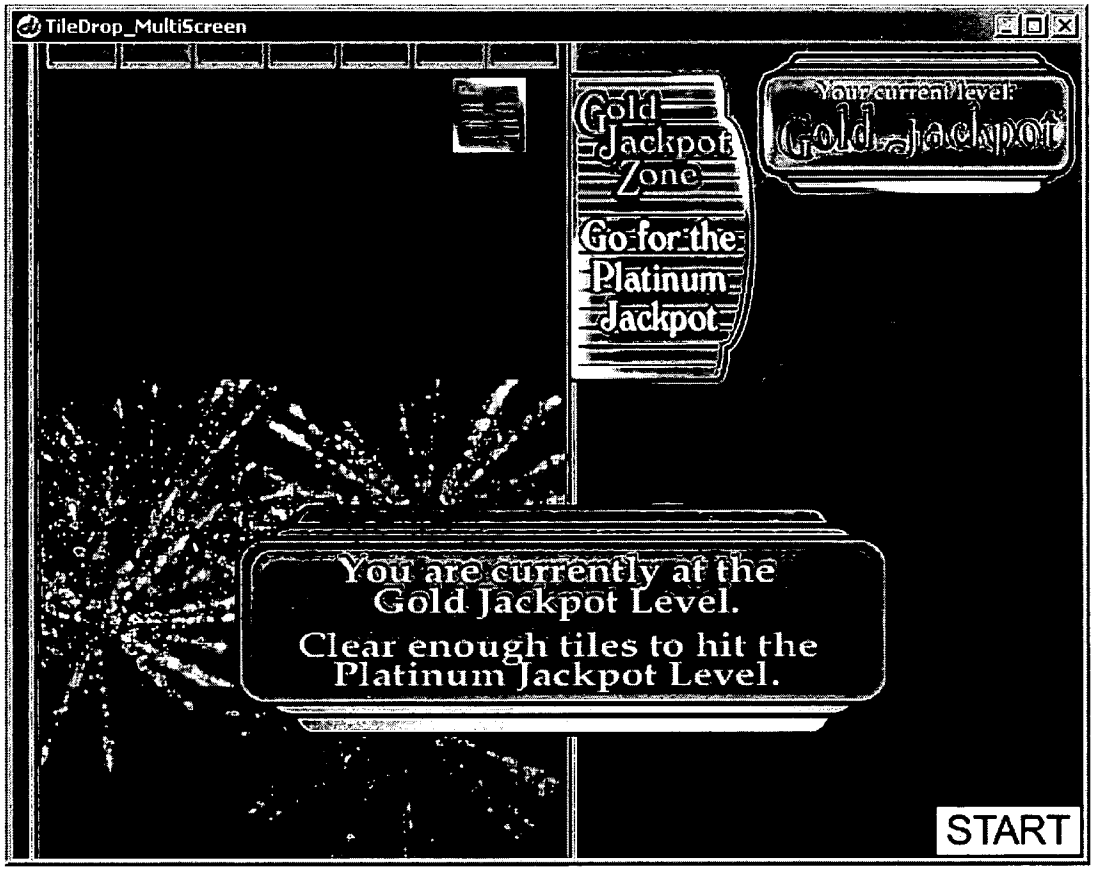

Round three of the bonus game begins as illustrated in FIG. 17. The player is given a new tile layout on the playfield. The player has four picks or selections from the "Pick One" selection box to try to manipulate the tile arrangement for positions in the Gold Jackpot area in order to win the Gold Jackpot award and advance to round four. In round three of this example, from the "Pick One" selection box, the player selects the purple-arrows symbol, the yellow-squares symbol, the green-triangle symbol, and finally the blue-diamond symbol. The selection of the blue-diamond symbol causes all but one tile to drop, as shown in FIG. 18. This changes the Silver Jackpot award to a Gold Jackpot award and begins round four, giving the player the opportunity to go for the Platinum Jackpot award.

Figure 19:
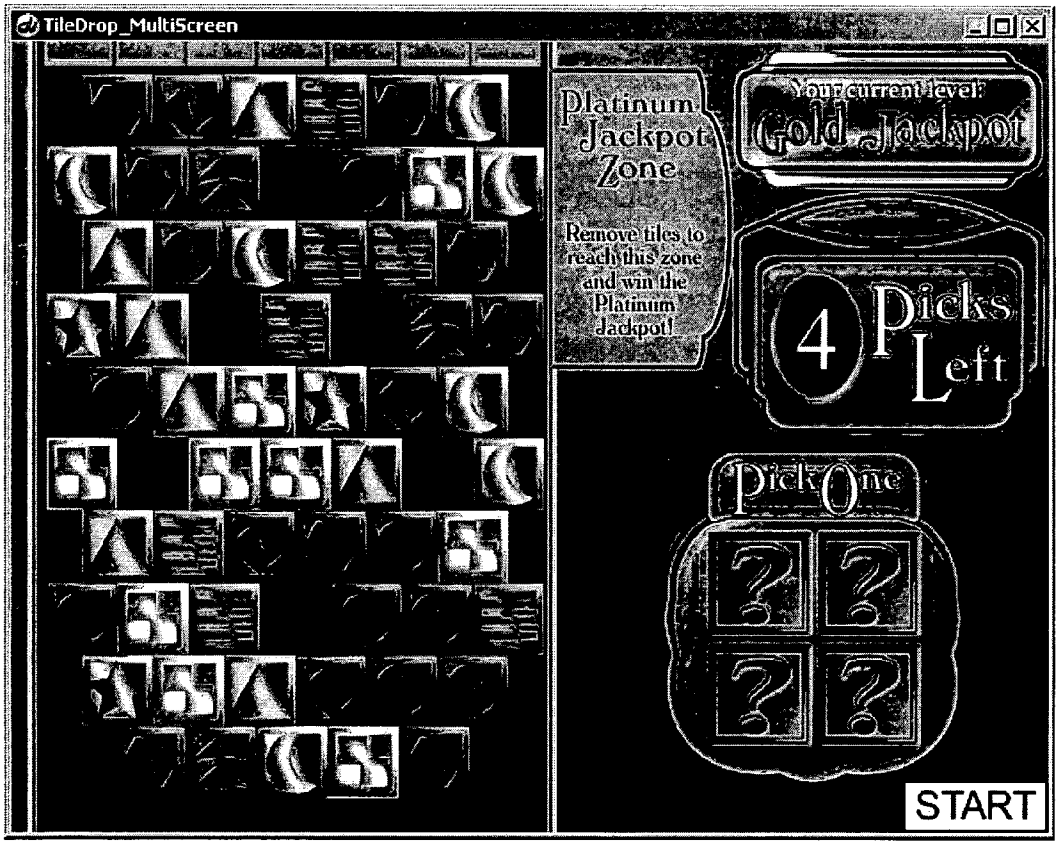

FIG. 19 shows one possible playfield for the start of round four. By examining the configuration of FIG. 19, it can be seen that, if the four picks are pink hexagon, orange horizontal lines, green triangle and silver star, then the remaining symbols would all be within the Platinum Jackpot area, and the player would win the largest jackpot.

Figure 20:
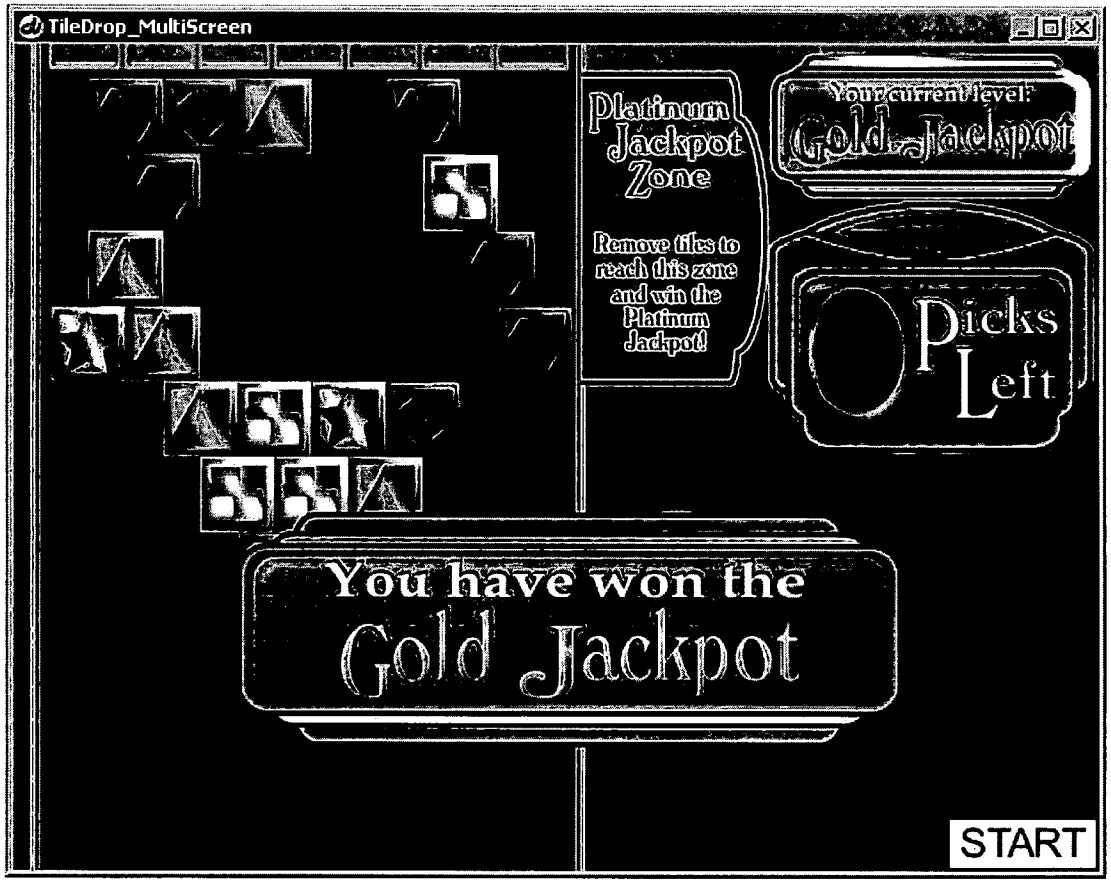

As shown in FIG. 20, the player has selected the orange-horizontal-lines symbol, the cyan-moon symbol, the purple-arrows symbol and the red-circle symbol. This resulted in seven tiles remaining outside of the Platinum Jackpot area. The player did not win the Platinum Jackpot, and the game ends by showing that the final award is the Gold Jackpot. The player receives the value of the Gold Jackpot by credits posted on the machine or in other methods known in the art, such as paying out coins, a "hand pay", electronic funds transfer to the player's slot-club account or credit card or to the player's account on a gaming server, just to name a few examples. The game also signals the reset of the Gold Jackpot progressive meter, perhaps in an embodiment where the meter is external to the gaming machine.

There are many methods that can be used to construct the playfield, or game board. It is not important how they are constructed but rather that the mathematical analysis of the boards yields a desired distribution of the final results. A method that was used for the embodiment described in FIGS. 9-20 will be discussed below.

As is well known in the art, the expected value (EV) of a bonus game is the sum of each possible result, weighted by the respective probability of that result. In this example, there are four possible results, or awards, and a player will always receive one of the four progressive awards. Table 1 shows a possible target result table for this bonus game. That is, given the expected jackpot values shown in the column Value, the designer would like to set the expected return of the bonus game to approximately $30.66 by distributing the awards as shown in the Probability column of Table 1.

Table 1

| | Value | Probability | EV | 1 in X |
|---|---|---|---|---|
| Platinum Jackpot | $1,200.00 | 0.0066667 | $ 8.00 | 150 |
| Gold Jackpot | $ 120.00 | 0.0666667 | $ 8.00 | 15 |
| Silver Jackpot | $ 24.00 | 0.4 | $ 9.60 | 2.5 |
| Bronze Jackpot | $ 9.60 | 0.5266667 | $ 5.06 | 1.898734 |
| Value of Bonus | | 1.00 | $30.66 | |

Before looking at the construction of the boards, it is useful to look at the methodology used for associating the four tiles with the question marks of the selection box. Although any acceptable method that is mathematically sound can be used to choose the symbols hidden by the question marks of the selection box, this embodiment uses the following method. There are nine different symbols within a set of symbols: {Green Triangle, Red Circle, Pink Hexagon, Yellow Squares, Silver Star, Cyan Moon, Blue Diamond, Purple Arrows, Orange Horizontal Lines}.

At the start of each bonus game, these symbols are randomly mapped to icon tiles called A, B, C, D, E, F, G, H and I; thus, the same starting playfield may be used, but will have a different appearance, or tile arrangement, each time. In one game, the red-circle symbols are mapped to the "A" icon while they are mapped to the "E" icon in another. The board-construction process is carried out using the letter icons. In this example, the tiles that carry the A-through-G icons may be picked by the player, while tiles that carry the H or I icons cannot be selected by the player; thus, the tiles that carry the H or I icons will "fall" only when their connection path is broken. The board could also be constructed with all tile icons being selectable by the player, without departing from the invention.

For this example, for the first pick of each round, the icon tiles A, B, C and D are randomly placed behind each of the four question marks. After a symbol is selected by the player from the selection box, the E icon tile is mixed in with the three tiles that were not selected, and they are randomly placed again behind each of the four question marks of the selection box. After the second pick, the F icon tile is placed randomly with the three unselected symbols and finally, for the fourth pick, the G icon tile is mixed in with the three tiles not selected during the third pick.

For example, on the first pick, there is the choice of this list of icon tiles: {A, B, C, D}. If B is selected as the first pick, then icon tile E is added, replacing B. So on pick two, there is a hidden choice of the following: {A, C, D, E}. On the second pick, icon tile C is chosen. This icon tile is replaced with F. The third pick will have hidden choices of: {A, D, E, F}. On the third pick, E is chosen. This icon tile is replaced with G. So on the fourth round, the possible hidden choices are: {A, D, F, G}. And then, on the fourth and final pick, tile icon G is selected. So, the consecutive award picks are {B, C, E, G}.

Given this selection and replacement schedule of icon tiles, there are thirty-five different possible order-independent combinations (i.e. not permutations, of which there are many more than thirty-five) of player picks. The actual order of the way the tiles are picked has no bearing on the game, such that selecting in the order of B→E→C→G will result in the same outcome as the selection of C→B→E→G. However, it should be noted that icon tile G would always be the last tile picked, since it can only enter the matrix on the fourth and final pick. Similarly, for this four-icon tile-selection order, tile icon E could never be available on the first pick.

A simple computer program is written to determine what the possible probabilities are for each of these thirty-five outcomes. The probability of each outcome is shown in Table 2.

Table 2

| | Tile icon | Tile icon | Tile icon | Tile icon | Probability of player pick combination |
|---|---|---|---|---|---|
| 1 | A | B | C | D | 0.09375 |
| 2 | A | B | C | E | 0.07031 |
| 3 | A | B | C | F | 0.04688 |
| 4 | A | B | C | G | 0.02344 |
| 5 | A | B | D | E | 0.07031 |
| 6 | A | B | D | F | 0.04688 |
| 7 | A | B | D | G | 0.02344 |
| 8 | A | B | E | F | 0.03125 |
| 9 | A | B | E | G | 0.01563 |
| 10 | A | B | F | G | 0.00781 |
| 11 | A | C | D | E | 0.07031 |
| 12 | A | C | D | F | 0.04688 |
| 13 | A | C | D | G | 0.02344 |
| 14 | A | C | E | F | 0.03125 |
| 15 | A | C | E | G | 0.01563 |
| 16 | A | C | F | G | 0.00781 |
| 17 | A | D | E | F | 0.03125 |
| 18 | A | D | E | G | 0.01563 |
| 19 | A | D | F | G | 0.00781 |
| 20 | A | E | F | G | 0.00391 |
| 21 | B | C | D | E | 0.07031 |
| 22 | B | C | D | F | 0.04688 |
| 23 | B | C | D | G | 0.02344 |

Table 2-continued

| | Tile icon | Tile icon | Tile icon | Tile icon | Probability of player pick combination |
|---|---|---|---|---|---|
| 24 | B | C | E | F | 0.03125 |
| 25 | B | C | E | G | 0.01563 |
| 26 | B | C | F | G | 0.00781 |
| 27 | B | D | E | F | 0.03125 |
| 28 | B | D | E | G | 0.01563 |
| 29 | B | D | F | G | 0.00781 |
| 30 | B | E | F | G | 0.00391 |
| 31 | C | D | E | F | 0.03125 |
| 32 | C | D | E | G | 0.01563 |
| 33 | C | D | F | G | 0.00781 |

Table 2-continued

| | Tile icon | Tile icon | Tile icon | Tile icon | Probability of player pick combination |
|---|---|---|---|---|---|
| 34 | C | E | F | G | 0.00391 |
| 35 | D | E | F | G | 0.00391 |
| | | | | | 1.00000 |

While Table 1 shows the probability of each award, the game feature that allows the player to only keep the highest prize that they win requires that the win percentages for each level be calculated. Below it will be shown how these probabilities are created, to provide the Table 1 distribution. Based on the probability for each award in Table 1, we can construct the probability of advancement on each level, as shown in Table 3.

Looking at round one, the board is constructed such that any combination of four picks will cause the tile arrangement to collapse into the position of the Bronze Jackpot area. The probability to achieve this is 1, as all games play the first and second rounds. The probability to continue on is therefore 1 (100%), which means the player cannot win the "previous award" such that the player loses the game. Moving to round two, the probability to get there is the product of the first two columns in the round one row of Table 3 (1×1=1). The probability to continue on (chances to continue divided by all chances as shown in Table 1) is:

$$(0.4+0.066666667+0.006666667)/(0.526666667+0.4+0.066666667+0.006666667)=0.473333333$$

Thus, the probability of not continuing past round two is 1−0.473333333=0.526666667, which is the probability of winning the Bronze Jackpot, as verified in Table 1.

For round three, the total probability to get there is the product of the first two columns on the round-two line (1×0.473333333=0.473333333). The probability to continue on is computed in the same way as above:

$$(0.066666667+0.006666667)/(0.4+0.066666667+0.006666667)=0.154929577$$

Thus the probability not to continue beyond round three is 1−0.154929577=0.845070423. The net probability of not advancing from round three (and thus winning the Silver Jackpot award) is the product of the probability to get to round three (column 1) times the probability to lose the round:

$$0.473333333*0.845070423=0.4$$

This again matches the Silver Jackpot probability in Table 1. The table is completed working down line to line in a similar manner.

Table 3

| | Probability to get here | Probability to continue on | Probability to lose round (win last Award) | Net Probability of this award | Award won |
|---|---|---|---|---|---|
| Round 1 | 1 | 1 | 0 | 0 | Loss (no award) |
| Round 2 | 1 | 0.473333333 | 0.526666667 | 0.526666667 | Bronze |
| Round 3 | 0.473333333 | 0.154929577 | 0.845070423 | 0.4 | Silver |
| Round 4 | 0.073333333 | 0.090909091 | 0.909090909 | 0.066666667 | Gold |
| | 0.006666667 | | 1 | 0.006666667 | Platinum |
| | | | | 1.00 | |

The second column of Table 3 shows the probability to continue in each round, which is key to constructing the game boards. The board for each round should be constructed such that the player achieves the jackpot with the probability shown in this column.

A computer program well understood in the art was written to assist in the generation of the game boards. The game designer specifies which playfield positions will have tiles, allowing the designer to incorporate symmetry, designs or other interesting features in the game boards. The game designer also specifies a target percentage, which is the desired percentage of winning boards. For a given round the target percentage is the second column "Probability to continue on" value in Table 3. Finally, the computer program uses the probabilities of Table 2 to quantify the value of each winning combination found.

The computer program randomly iterates through possible assignments of the A, B, C, D, E, F, G, H, and I icons to the specified tiles in the playfield and for each of the thirty-five possible play outcomes in Table 2. The program determines if that play outcome "wins" the round. The program sums the probabilities in the rightmost column of Table 2 for each winning combination, and reports board layouts and the probability of winning those boards, which is close to the desired target percentage. The program then goes into an interactive mode to allow the designer to modify tiles to make the board appear more interesting. This is desirable to make the boards more interesting to the player and is easy to do because many of the tiles in any layout may have many symbol assignments without changing the probability of winning the board.

Using a target probability of 0.47333333 for round two, the program returns a board where the moves on rows 1-10 and 12 in Table 2 are winners. Adding up the probability from Table 2 of each of these eleven ways to win the Silver Jackpot award, the probability of winning on that board would be 0.47658, a little higher than the target. Another board that the program returns is configured such that the picks on lines 1, 6, 7, 11, 12, 13, 17, 22, 27, 28, 29 and 31 of Table 2 will generate a win: adding the probability of each of these lines in Table 2 results in a total probability to win on this board of 0.46877.

Since the sum of the probability of winning combinations in Table 2 will not likely hit precise numbers like the desired 0.473333333 probability to win the Silver Jackpot award to advance to round three, each round uses several different boards, and they are randomly selected using a weighted table which allows the overall winning probability to be fine tuned to closely hit the target. Ideally, several possible starting boards are used for each level of the game, but for clarity it is shown how to combine the two example boards above to arrive at an overall expected win rate that is very close to a desired value.

Table 4 shows how the two boards discussed above are weighted to result in a win percentage that is very close to the target value. At the start of the round, as is well known in the art, a random number that may take on 240 different values is selected. For 140 of those random number selections the first board will be used, and on the other 100 random number selections the second board will be used generating a weighted probability of winning on the round of 0.47333. This process is used in the same manner for each possible round in the game.

Table 4

| Board | Probability to win | Weight | Weighted Probability |
|---|---|---|---|
| 1 | 0.47658 | 140 | 0.27801 |
| 2 | 0.46877 | 100 | 0.19532 |
| | | 240 | 0.47333 |

While the present invention has been described with reference to particular embodiments, those skilled in the art will recognize that many changes may be made thereto without departing from the scope of the present invention. Each of these embodiments and variants thereof is contemplated as falling within the scope of the claimed invention.

The invention claimed is:

1. A wagering gaming machine comprising:

a video monitor;

a cpu for operating the video monitor and other aspects of the gaming machine according to a gameplay methodology;

a wager input device; and a player command input device that receives player selections, including player gameplay selections, in the course of gameplay, the gameplay methodology generating a construct on the video monitor that changes in shape through increasing or decreasing in size along at least one dimension, a change in size being affected by a player's gameplay selection; the gameplay methodology further evaluating an outcome based upon an aspect of the size along the at least one dimension, and providing an award, if any, in view of a predetermined outcome evaluation award format, wherein the video monitor has a playfield generated thereon with a base defined on the playfield, the player gameplay selections causing the construct to change in terms of a distance of a furthest point of the construct from the base the award format being predicated upon said distance, wherein upon gameplay initiation the construct is an array of interconnected objects, at least some of the objects being of differing quality, a player gameplay selection potentially resulting in elimination of objects of a certain quality from the array, and other objects which are no longer interconnected are also eliminated, said process of elimination potentially resulting in a decreased distance between the base and a now-furthest object from the base.

2. The gaming machine of claim 1, wherein the award format is represented by a scale shown along the playfield related to distance from the base, the position of a furthest object along the scale determining an award, if any.

3. The gaming machine of claim 2, wherein achievement of an award in a first gameplay results in another gameplay with an opportunity to achieve an award of relatively greater value.

4. The gaming machine of claim 2, wherein the objects are in the form of tiles, the tiles being organized into subsets having differing indicia, the base being at a defined top of the playfield, the tiles being interconnected by a connecting relationship, a tile which is no longer connected to at least one other tile after a player gameplay selection appearing to fall away from the base, the award format being predicated upon the tile furthest from the base.

5. The gaming machine of claim 4, wherein the scale includes at least one decrease in award value and at least one increase in award value with increasing distance from the base.

6. The gaming machine of claim 4, wherein said player gameplay selection comprises a player selecting from a group of initially-hidden tile indicia, a tile indicium being selected from said group thereby being eliminated from said array.

* * * * *